US007965247B2

(12) United States Patent
Laubner et al.

(10) Patent No.: US 7,965,247 B2
(45) **Date of Patent: *Jun. 21, 2011**

(54) MULTIBAND ANTENNAS AND DEVICES

(75) Inventors: Thomas S. Laubner, Merrimac, MA (US); Robert Schilling, Londonderry, NH (US)

(73) Assignee: M/A-COM Technology Solutions Holdings, Inc., Lowell, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/728,422

(22) Filed: Mar. 22, 2010

(65) Prior Publication Data

US 2010/0225550 A1 Sep. 9, 2010

Related U.S. Application Data

(63) Continuation of application No. 11/532,942, filed on Sep. 19, 2006, now Pat. No. 7,683,843.

(60) Provisional application No. 60/734,403, filed on Nov. 8, 2005.

(51) Int. Cl.
*H01Q 1/32* (2006.01)

(52) U.S. Cl. ..... 343/713; 343/711

(58) Field of Classification Search ..... 343/702, 343/713, 711, 900
See application file for complete search history.

(56) References Cited

U.S. PATENT DOCUMENTS

| | | | | |
|---|---|---|---|---|
| 4,821,040 | A * | 4/1989 | Johnson et al. | 343/700 MS |
| 5,999,132 | A * | 12/1999 | Kitchener et al. | 343/702 |
| 6,809,698 | B2 * | 10/2004 | Tsai et al. | 343/795 |
| 7,253,770 | B2 * | 8/2007 | Yegin et al. | 343/700 MS |
| 7,683,843 | B2 * | 3/2010 | Laubner et al. | 343/713 |

FOREIGN PATENT DOCUMENTS

WO WO98/58422 * 12/1998

* cited by examiner

*Primary Examiner* — HoangAnh T Le
(74) *Attorney, Agent, or Firm* — Christopher P. Maiorana, PC

(57) ABSTRACT

An apparatus includes an antenna (e.g., a monopole), a first load, and a second load. The antenna, which extends substantially along an axis, has a first end and a second end. The first load is coupled to the antenna at the first end, while the second load is coupled to the antenna between the first end and the second end. Both the first and second loads are symmetrical with reference to the axis. The apparatus is arranged to operate in at least two frequency bands, such as the AMPS band from about 824 MHz to 894 MHz and the PCS band from about 1850 MHz to 1990 MHz.

19 Claims, 5 Drawing Sheets

MULTIBAND ANTENNAS AND DEVICES

CROSS-REFERENCE TO RELATED APPLICATIONS

This is a continuation of U.S. Ser. No. 11/532,942, filed Sep. 19, 2006 now U.S. Pat. No. 7,683,843, which is incorporated by reference. This application claims the benefit of U.S. Provisional Application No. 60/734,403, filed on Nov. 8, 2005. This provisional application is incorporated herein by reference in its entirety.

BACKGROUND

It is generally desirable to reduce the size of electronic components and devices. For instance, a demand exists for more compact antennas to be used in various wireless applications. In addition, there is a demand for antennas capable of operating in multiple frequency bands.

A typical vehicular antenna system for cellular telephony employs a large antenna element (e.g., three inches or greater) to meet specified performance requirements. The large antenna element is conventionally mounted on a base and is typically enclosed by a flexible whip or rigid fin. This arrangement can produce a relatively large profile on the vehicle's exterior surface. Unfortunately, such profiles are inconsistent with typical vehicle design objectives and aesthetics.

Thus, there is a need to provide antennas and antenna devices having reduced sizes, while still meeting specified performance criteria. Moreover, as wireless applications become more pervasive, there is a further need for compact antennas that can operate in more than one frequency band.

SUMMARY

The present invention provides an apparatus having an antenna (e.g., a monopole), a first load, and a second load. The antenna, which extends substantially along an axis, has a first end and a second end. The first load is coupled to the antenna at the first end, while the second load is coupled to the antenna between the first end and the second end.

Both the first and second loads are symmetrical about the aforementioned axis. Also, the first load may be substantially linear and/or substantially orthogonal to the axis. However, the second load may have various shapes. For instance, the second load may include a U-shaped portion.

The apparatus is arranged to operate within at least two frequency bands. Examples these bands include the Advanced Mobile Phone System (AMPS) band from about 824 MHz to 894 MHz and the Personal Communications Service (PCS) band from about 1850 MHz to 1990 MHz. Further frequency bands include European Global System for Mobile Communications (GSM) band from about 880 MHz to about 960 MHz, and the European Digital Cellular System (DCS1800) band from about 1850 MHz to about 1880 MHz. However, the embodiments are not limited to these frequency bands.

The antenna, the first load, and the second load may be supported by a substrate, such as a printed circuit board. For example, these elements may be on a surface of the substrate. In turn, the substrate may be coupled or connected to a base that is configured to attach to a vehicle's surface. Moreover, a radome may surround the substrate and the base.

Further features and advantages of the invention will become apparent from the following description and accompanying drawings.

DETAILED DESCRIPTION

Various embodiments may be generally directed to antenna devices. Although embodiments may be described with a certain number of elements in a particular arrangement by way of example, the embodiments are not limited to such. For instance, embodiments may include greater or fewer elements, as well as other arrangements among elements.

Figure 1:
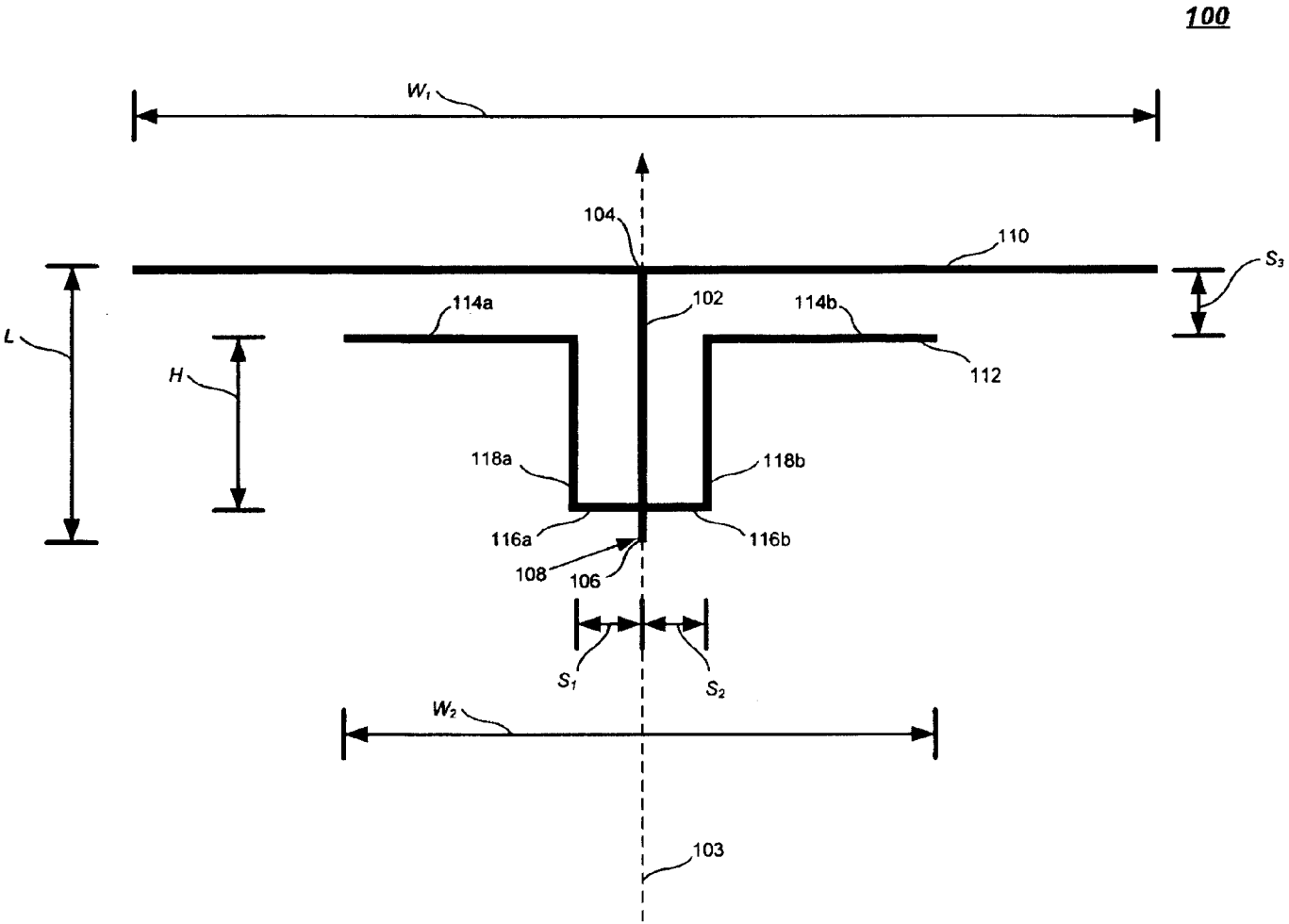
FIG. 1 is a view of an antenna device in accordance with an exemplary embodiment of the present invention.

FIG. 1 is a diagram of an antenna device 100 in accordance with an exemplary embodiment of the present invention. This device may be used to transmit and/or receive wireless signals in two or more frequency bands. As shown in FIG. 1, device 100 includes a monopole antenna 102, a first load 110 and a second load 112.

FIG. 1 shows monopole antenna 102 extending substantially along an axis 103. This axis may be substantially vertical. In addition, this drawing shows antenna 102 having a first end 104 and a second end 106. The distance between these ends is shown as a length, L. This length may be approximately 25 to 26 millimeters (i.e., about one inch). However, the embodiments are not limited to such. A feed point 108 is located substantially at second end 106. At this point, a signal conveying medium (such as a coaxial cable, wire(s), or trace(s)) may be coupled to antenna 102.

First linear load 110 may be attached to antenna 102 at or near first end 104. FIG. 1 shows first load 110 being symmetrical about antenna 102. First load 110 may be arranged for the transmission and reception of vertically polarized signals within a first frequency band. This first frequency band may include the Advanced Mobile Phone System (AMPS) band, which is from about 824 MHz to 894 MHz. Additionally or alternatively, this first frequency band may include the European GSM band from about 880 MHz to about 960 MHz. However, the embodiments are not limited to these exemplary frequency ranges.

As shown in FIG. 1, second linear load 112 is attached to antenna 102 at a position between feed point 108 and the location where first load 110 is attached. FIG. 1 also shows second load 112 being symmetrical about antenna 102.

Second load 112 may be arranged to provide for transmission and reception of vertically polarized signals within a second frequency band that is higher than the first frequency band. More particularly, second load 112 operates as a choke. This feature prevents currents at the second frequency band from propagating along antenna 102 past second load 112. This second frequency band may include the PCS band, which is from about 1850 MHz to 1990 MHz. Alternatively or additionally, this second frequency band may include the European DCS1800 band from about 1710 MHz to about 1880 MHz. The embodiments, however, are not limited to these examples.

As shown in FIG. 1, second load 112 comprises opposing segments 114*a* and 114*b*, and opposing segments 116*a* and 116*b*. These segments are substantially perpendicular to axis 103. In addition, second load 112 comprises opposing segments 118*a* and 118*b*, which are substantially parallel to axis 103. Moreover, FIG. 1 shows that these segments are symmetrical about antenna 102.

Segments 116 and 118 provide second load 112 with a U-shaped portion. This portion may increase the impedance of device 100 at the first frequency band to a value that is desirable for transmission and reception in the second frequency band.

FIG. 1 shows separations, S1, S2, and S3, which exist between second load 112, and the other components of device 100 (i.e., antenna 102 and first load 110). These separations may be set to affect the impedance of choke portion 114. In embodiments, these separations are substantially equal in magnitude.

As described above, loads 110 and 112 are symmetric with reference to antenna 102. Such a symmetric arrangement of loads in both the first and second frequency bands provides for cancellation of radiation (e.g., horizontal radiation) that would normally be emitted from asymmetrical loads. Other types of loads, such as helical and spiral loads, do not typically provide such cancellation. As a result of this symmetry, losses due to cross-polarization radiation are advantageously reduced. More particularly, such loading reduces efficiency losses attributed to conversions between vertically polarized energy and horizontally polarized energy.

Moreover, through loads 110 and 112, antenna device 100 performs as though it is "electrically taller" than its actual size. This feature may advantageously provide effective radiation resistance as presented by loads. Further, coupling between loads 110 and 112 serves to favorably alter the impedance of the load 110. Additionally, loads 110 and/or 112 may further serve to improve the Voltage Standing Wave Ratio (VSWR) bandwidth.

Also, a matching network (e.g., a passive network) may be coupled to antenna device at feed point 108. Such a matching network may be configured to further improve the VSWR.

Elements of antenna device 100 (such as antenna 102, first load 110, and second load 112) may be made from one or more suitable materials. Exemplary materials include conductors such as copper, stainless steel, and aluminum. However, embodiments of the present invention are not limited to these materials. Various thicknesses and cross sectional profiles may be employed with such conductors.

Various dimensions are shown in FIG. 1. For instance, FIG. 1 shows first load 110 having a width, $W_1$. Furthermore, second load 112 is shown having a height, H, and a width, $W_2$. Also, as described above, antenna 102 has a length L, and spacings $S_1$, $S_2$, and $S_3$ are associated with second load 112.

Figure 2A:
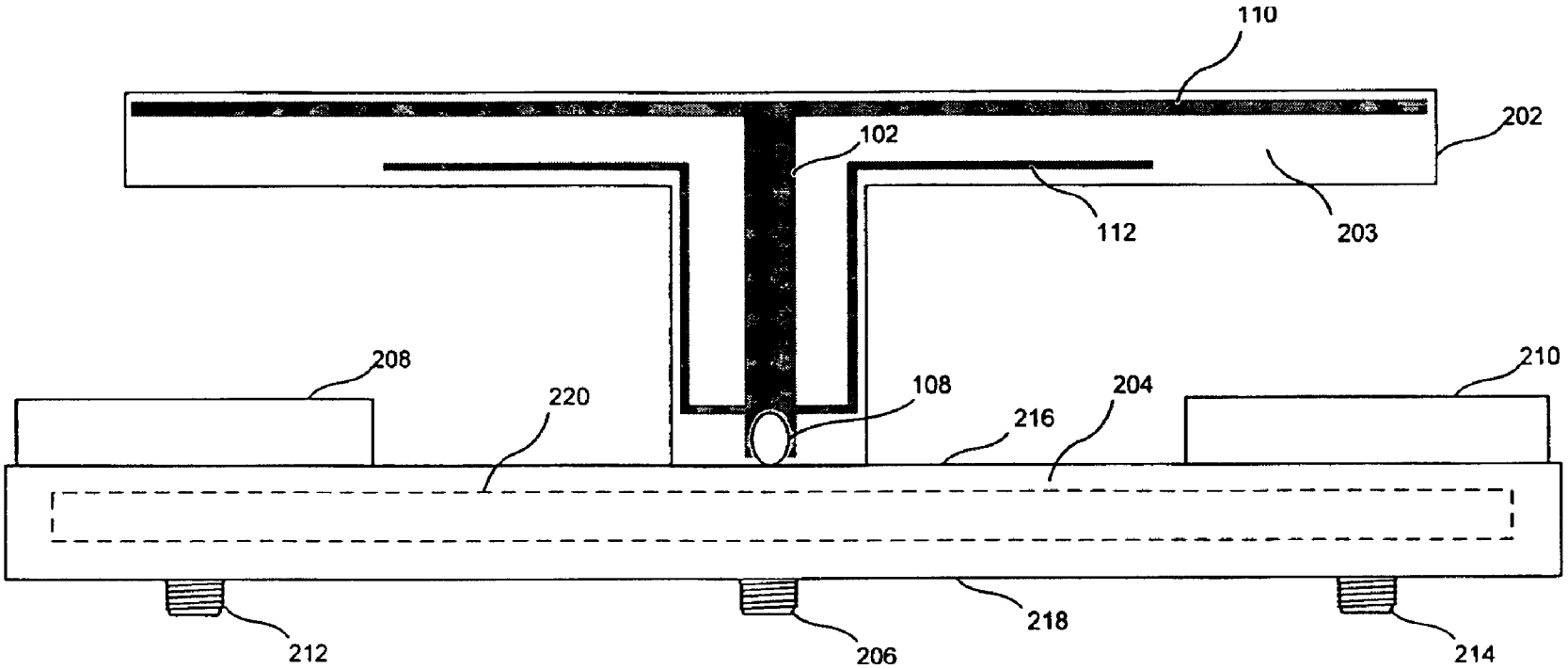
FIGS. 2A and 2B are views of a substrate supported antenna device.
Figure 2B:
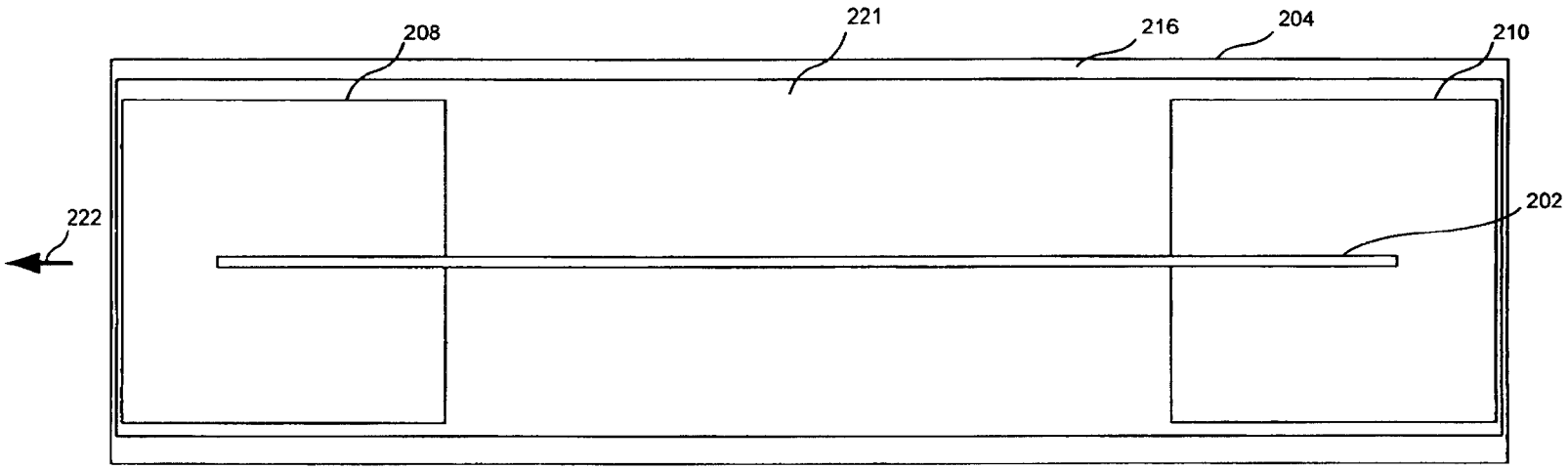

Embodiments of the present invention may include antenna devices supported by substrates. For example, FIGS. 2A and 2B illustrate an exemplary arrangement in which elements of antenna device 100 are supported by a printed circuit board (PCB) 202. In particular, FIG. 2A is a side view showing elements of antenna device 100 affixed or printed to a surface 203 of PCB 202.

In addition, PCB 202 is attached to a base 204 at a surface 216. This attachment may be made in various ways, such as with mechanical fasteners and/or adhesives. Substantial portions of surface 216 may composed of a conductive material to provide a ground plane.

FIG. 2A shows that base 204 has a surface 218 that is opposite to surface 216. This surface of base 204 may be attached to a vehicle, such as an automobile's exterior surface. This attachment may be made in various ways, such as with mechanical fasteners, adhesives, suction cups, and/or gaskets.

In embodiments, other antenna devices may also be attached to base 204. For example, FIG. 2A shows antenna devices 208 and 210. These devices may be of various types, such as printed, patch or microstrip antennas. In addition, devices 208 and 210 may support the transfer of various signals, such as cellular or satellite telephony signals, global positioning system (GPS) signals, video and/or radio broadcast signals (either analog or digital), and the like. For instance, in an exemplary arrangement, device 208 is a GPS patch antenna, device 210 is a digital satellite radio patch antenna, and the elements of device 100 operate as a dual band cellular antenna.

As shown in FIG. 2A, connectors 206, 212, and 214 are attached to base 204. These connectors provide electrical connections to antenna devices. For instance, connector 206 may be connected to feed point 108, connector 212 may be connected to antenna device 208, and connector 214 may be connected to antenna device 210. Transmission lines, such as coaxial cables, may attach to these connectors. In turn, such lines are coupled to one or more devices within the vehicle. Exemplary devices include cellular telephones, radio receivers, video receivers, computer devices (e.g., laptop computers, personal digital assistants (PDAs)), GPS receivers, and the like.

In alternative arrangements, antenna devices may share connectors through the employment of one or more diplexers. This feature advantageously reduces the number of cables needed to reach base 204.

Embodiments may include additional components. For example, FIG. 2A shows that base 204 may include a concealed inner cavity 220. Cavity 220 may contain various circuitry and/or components. Examples of such circuitry and components include amplifiers, diplexers, and/or matching networks.

For instance, cavity 220 may contain a first active low noise amplifier (LNA) coupled between device 208 and connector 212, a second active LNA coupled between device 210 and connector 214. Also, cavity 220 may contain a diplexer between feed point 108 and connector 206 to provide for bidirectional operation. Further, cavity 220 may contain one or more diplexers so that antenna devices may share connectors on surface 218. Additionally or alternatively, a matching network (e.g., an arrangement of one or more capacitors) may be disposed between feed point 108 and connector 206.

Cavity 220 may be walled with a conductive material, such as a zinc coating, to provide electromagnetic interference (EMI) shielding. However, other materials may be employed.

In further arrangements, circuitry and/or components may be placed in locations outside of cavity 220. Such locations may include one or more surfaces on base 204 and/or substrate 202. For example, a matching network may be placed on surface 216 of base 204. As described above, such a matching network may be coupled between feed point 108 and connector 206. Such circuitry and/or components may be enclosed by conductive materials to provide EMI shielding.

FIG. 2B is a top view of the arrangement of FIG. 2A. This view shows PCB 202 having a relatively narrow thickness. When aligned with a direction of travel 222, the arrangement provides reduced wind resistance. Also, FIG. 2B shows that a conductive material 221 may be disposed on surface 216 to provide a ground plane.

Figure 3:
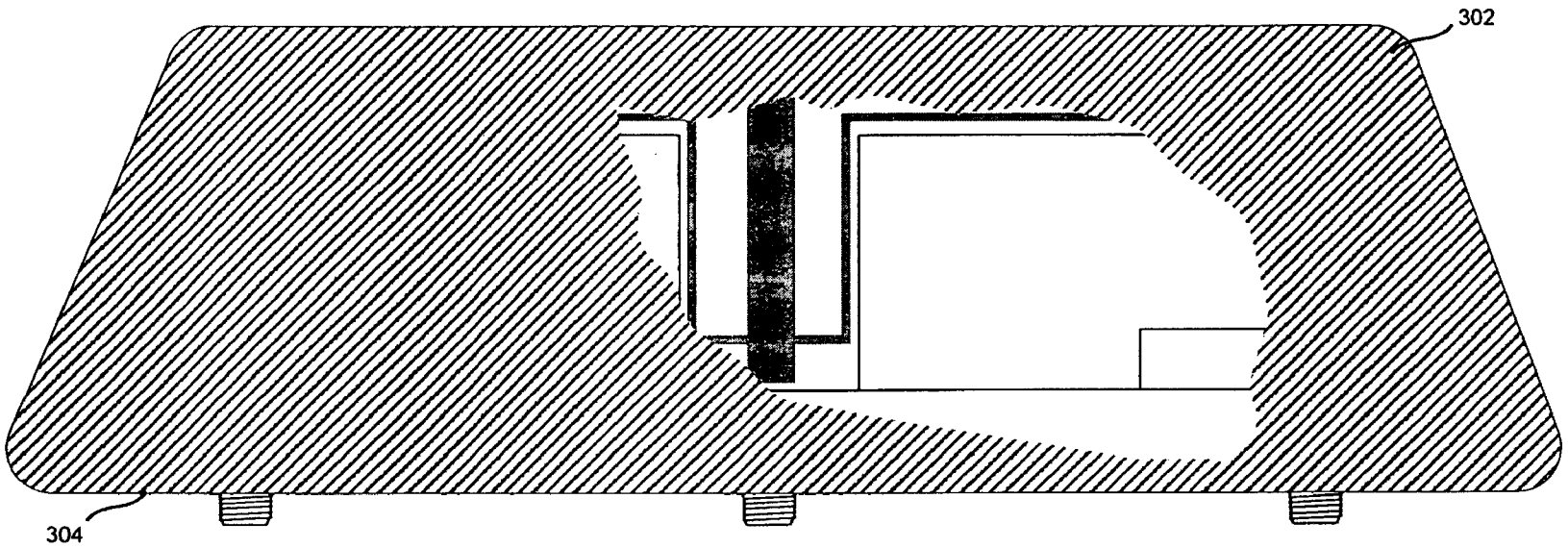
FIG. 3 is a cut-away view of a substrate supported antenna device enclosed by a radome.

FIG. 3 is a cut away side view of an arrangement that that is similar to the arrangement of FIGS. 2A and 2B. However, this arrangement includes a radome 302 that covers elements of FIGS. 2A and 2B, such as substrate 202, base 204, device 208, and device 210.

Figure 4:
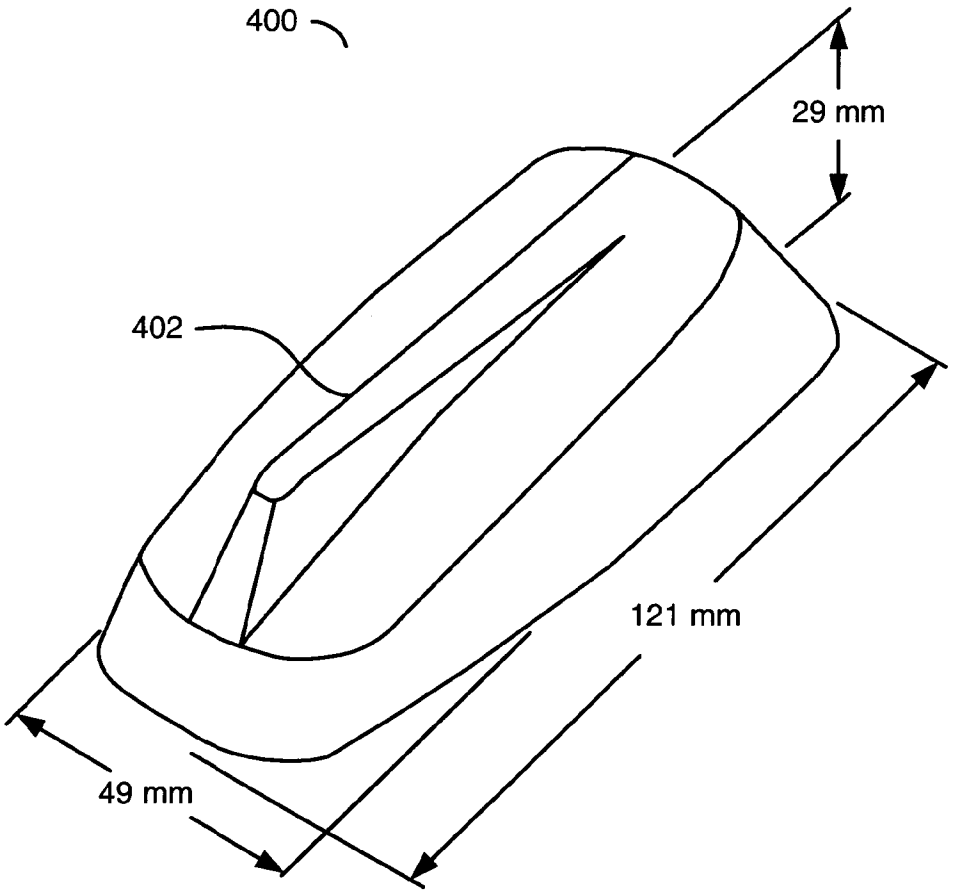
FIG. 4 is a perspective view of a radome.

FIG. 4 is a perspective view of a further radome 400 that may be employed to cover the elements of FIGS. 2A and 2B. Radome 400 provides a low profile, aerodynamic shape. As shown in FIG. 4, radome 400 includes a protrusion 402 to accommodate substrate 202.

Radomes 302 and 400 may be made of various materials, such as plastics having suitable microwave properties. Examples of such properties include a dielectric constant between 1 and 5, and a loss tangent between 0.01 and 0.001. In embodiments, such radomes may be composed of an ultraviolet (UV) stable injection molded plastic.

Numerous specific details have been set forth herein to provide a thorough understanding of the embodiments. It will be understood by those skilled in the art, however, that the embodiments may be practiced without these specific details.

In other instances, well-known operations, components and circuits have not been described in detail so as not to obscure the embodiments. It can be appreciated that the specific structural and functional details disclosed herein may be representative and do not necessarily limit the scope of the embodiments.

For instance, while an exemplary height of 25 to 26 mm is disclosed, one of ordinary skill would be able to modify the height and additionally as well as the size and location of the loads to achieve an acceptable dual band performance. Additionally, while the dual bands described herein are in the AMPS band and PCS band ranges, one would also be able to modify the first and second loads of the antenna device (both the size and shape of antenna and loads) to properly operate in different dual band configurations. Examples of such bands include the European Global System for Mobile Communications (GSM) band from approximately 880 to 960 MHz and the European Digital Cellular System (DCS 1800) band from approximately 1710 to 1880 MHz. Moreover, embodiments of the present invention may operate in more than two bands. For instance, embodiments may include additional (e.g., symmetric) loads.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. An apparatus, comprising:

an antenna extending substantially along an axis, the antenna having a first end and a second end;

a first load coupled to the antenna at the first end;

a second load coupled to the antenna between the first end and the second end, wherein (i) the first load and the second load are each symmetrical with reference to the axis, and (ii) the first load and the second load are arranged to exchange first wireless signals within a first frequency band and second wireless signals within a second frequency band; and a substrate, wherein the substrate supports the antenna, the first load, and the second load.

2. The apparatus of claim 1, wherein the antenna is a monopole antenna.

3. The apparatus of claim 1, wherein the second load has a U-shaped portion comprising a first 90° bend and a second 90° bend, wherein said U-shaped portion of said second load increases the impedance of the antenna at the first frequency band to a value desirable for transmission and reception in the second frequency band.

4. The apparatus of claim 3, wherein the U-shaped portion is symmetrical with reference to the axis.

5. The apparatus of claim 1, wherein the first load is substantially linear.

6. The apparatus of claim 5, wherein the first load (i) is substantially orthogonal to the axis and (ii) is positioned in line with a direction of travel of said antenna.

7. The apparatus of claim 1, wherein (i) the first frequency band is from about 824 MHZ to 894 MHZ, and (ii) the second frequency band is from about 1850 MHZ to 1990 MHZ.

8. The apparatus of claim 1, wherein (i) the first frequency band is from about 880 MHZ to 960 MHZ, and (ii) the second frequency band is from about 1710 MHZ to 1880 MHZ.

9. The apparatus of claim 1, wherein the antenna has a length of approximately one inch along the axis.

10. The apparatus of claim 1, wherein the axis is substantially vertical.

11. The apparatus of claim 1, wherein the antenna operates through said first load and said second load as though said apparatus were electrically taller than a physical size of said apparatus.

12. The apparatus of claim 1, wherein a matching network is coupled to said antenna at said second end and said matching network is configured to further improve a Voltage Standing Wave Ratio (VSWR).

13. An apparatus, comprising:

a substrate having a surface;

an antenna disposed on the surface, the antenna extending substantially along an axis, and the antenna having a first end and a second end;

a first load disposed on the surface, the first load coupled to the antenna at the first end;

a second load disposed on the surface, the second load coupled to the antenna between the first end and the second end, wherein (i) the first load and the second load are each symmetrical with reference to the axis, and (ii) the first load and the second load are arranged to exchange first wireless signals within a first frequency band and second wireless signals within a second frequency band; and a radome enclosing the antenna, the first load, and the second load.

14. The apparatus of claim 13, wherein the surface is substantially within a vertical plane.

15. The apparatus of claim 13, further comprising a base coupled to the substrate, wherein the base is configured to mount to an exterior surface of a vehicle.

16. The apparatus of claim 13, wherein the first load is substantially linear.

17. The apparatus of claim 16, wherein the first load (i) is substantially orthogonal to the axis and (ii) is positioned in line with a direction of travel of said antenna.

18. The apparatus of claim 13, wherein the second load has a U-shaped portion comprising a first 90° bend and a second 90° bend, wherein said U-shaped portion of said second load increases the impedance of the antenna at the first frequency band to a value desirable for transmission and reception in the second frequency band and that is symmetrical with reference to the axis.

19. An apparatus, comprising:

an antenna extending substantially along an axis, the antenna having a first end and a second end;

a first load coupled to the antenna at the first end, the first load arranged for the antenna to operate in a first frequency band; and a second load coupled to the antenna between the first end and the second end, the second load arranged for the antenna to operate in a second frequency band that is higher than the first frequency band, wherein (i) the first load and the second load are each symmetrical with reference to the axis, and (ii) the first load and the second load are arranged to exchange first wireless signals within a first frequency band and second wireless signals within a second frequency band; and a substrate, wherein the substrate supports the antenna, the first load, and the second load.

* * * * *